United States Patent [19]

Becker

[11] Patent Number: 5,066,221

[45] Date of Patent: Nov. 19, 1991

[54] FITTING FOR JOINING AT LEAST ONE HYBRID BURNER TO APPARATUS FOR SUPPLYING A FLUID FUEL

[75] Inventor: Bernard Becker, Mülheim an der Ruhr, Fed. Rep. of Germany

[73] Assignee: Siemens Aktiengesellschaft, Munich, Fed. Rep. of Germany

[21] Appl. No.: 639,600

[22] Filed: Jan. 9, 1991

[30] Foreign Application Priority Data

Jan. 9, 1990 [DE] Fed. Rep. of Germany ..... 4000446

[51] Int. Cl.[5] ..... F23Q 9/08

[52] U.S. Cl. ..... 431/280; 60/748; 137/625.18

[58] Field of Search ..... 431/280, 281; 60/747, 60/748; 137/625.18

[56] References Cited

U.S. PATENT DOCUMENTS 2,335,085 11/1943 Roberts ..... 431/280
3,176,753 4/1965 Townsend ..... 431/280
4,589,260 5/1986 Krockow .
4,701,124 10/1987 Maghon et al. .

FOREIGN PATENT DOCUMENTS 0276696 8/1988 European Pat. Off. .
3606625 9/1986 Fed. Rep. of Germany .

*Primary Examiner*—Carroll B. Dority

*Attorney, Agent, or Firm*—Herbert L. Lerner; Laurence A. Greenberg

[57] ABSTRACT

A hybrid burner has a main burner operable with premixing combustion and an auxiliary burner operable with premixing and/or diffusion combustion alone or operable to furnish a pilot light for the main burner. A fitting connects at least one hybrid burner to a main supply apparatus and an auxiliary supply apparatus. The fitting includes a change-over element. A main feed line communicates between the change-over element and the main supply apparatus, an auxiliary feed line communicates between the change-over element and the auxiliary supply apparatus, a main tie line communicates between the change-over element and the main burner and an auxiliary tie line communicates between the change-over element and the auxiliary burner. The change-over element is operable in at least one first and at least one second switching state. In the first switching state the main feed line communicates with the main tie line and the auxiliary feed line communicates with the auxiliary tie line. In the second switching state the main feed line communicates with the auxiliary tie line and the auxiliary feed line is blocked. A switchable throttle element is connected in series with the auxiliary tie line for conducting a fuel flow. The throttle element is operable in the first switching state with relatively slight throttling action and in the second switching state with relatively great throttling action.

27 Claims, 2 Drawing Sheets

FITTING FOR JOINING AT LEAST ONE HYBRID BURNER TO APPARATUS FOR SUPPLYING A FLUID FUEL

The invention relates to a fitting for joining at least one hybrid burner to apparatus for supplying a fluid fuel, such as for use in gas turbine systems.

As described in European Patent No. 0 108 361 B1, corresponding to U.S. Pat. No. 4,589,260, a hybrid burner has at least one main burner which can be operated as a premixing burner, and at least one auxiliary burner which can be operated as a diffusion burner. In heavy-duty operation, the predominant portion of the fuel is burned by the main burner, while the auxiliary burner furnishes a "pilot light" with a small amount of the fuel, which may be necessary to stabilize operation of the main burner. In contrast, in low-load operation the supply of fuel to the main burner may be omitted completely under some circumstances, so that only the auxiliary burner is operated. The term "burner" in the present context should be understood as referring to a total unit including a fuel nozzle or an array of fuel nozzles and a delivery and/or carrying system for combustion air and/or for an air and fuel mixture in the case of premixing combustion. It is conceivable for a delivery system for combustion air to belong to a plurality of burners in common. On this point, reference is made to European Patent No. 0 108 361 B1, corresponding to U.S. Pat. No. 4,589,260, which relates to a hybrid burner having a diffusion burner configuration that uses the same delivery system for combustion air as the premixing burner configuration that is also present.

A hybrid burner of a similar type is described in German Published, Non-Prosecuted Application DE 36 06 625 A1, corresponding to U.S. Pat. No. 4,701,124 and Reissue Application Ser. No. 415,997, filed Oct. 2, 1989. However, that hybrid burner has an auxiliary burner of the premixing type which is to be operated in a stable manner by keeping the mixing ratio of air and fuel to be burnt within a suitable range. The invention is deemed to be applicable to hybrid burners with auxiliary burners of all types, including those which are suitable for both diffusion and premixing combustion.

In Published European Application No. 0 276 696 A2, corresponding to U.S. Application Ser. No. 425,432, filed Oct. 20, 1989, a hybrid burner of the above type is described that can be operated with two different fluid fuels, namely gas and/or oil. The present invention also includes fittings for such hybrid burners, although for the sake of simplicity the ensuing description will refer only to hybrid burners for operation with a single fuel. A fitting for connecting at least one hybrid burner to apparatus for supplying a fluid fuel is introduced in European Patent No. 0 108 361 B1, corresponding to U.S. Pat. No. 4,589,260. That configuration connects a main pumping apparatus, including a fuel pump with a fuel control valve on its output side to at least one main burner and also connects a pilot feed apparatus of similar structure, which is used both for generating the pilot light and for diffusion burner operation without use of the main burner, to at least one auxiliary burner. In order to operate a plurality of hybrid burners through a single fitting, the main and pilot feed apparatus each have a distributor connected to the output side thereof, from which a tie line leads to each hybrid burner. In order to keep the throughput of the fuel supplied to the hybrid burner constant and independent of any pressure fluctuations that may occur in the hybrid burner, it is suitable to provide a feed line with a throttle action, at which a pressure loss of considerable magnitude occurs. In the case where a plurality of hybrid burners are operated in parallel, throttle restrictions in the tie lines between the fuel feed apparatus and the hybrid burners also bring about a uniform distribution of the fuel to the various burners.

However, that kind of fitting can lead to problems in operation of the auxiliary burner, if the fuel throughputs necessary for the two types of operation are markedly different, for instance if the fuel throughput necessary for "pilot burner operation" is only about 10% of that for "diffusion operation". The pressure loss at a throttle restriction is proportional to the square of the fluid throughput. If the fluid throughputs for pilot and diffusion burner operation differ by a factor of 10, then the respective pressure losses differ by a factor of 100. If a throttle restriction is dimensioned in such a way that an acceptable pressure loss occurs for diffusion burner operation, preferably in the range between approximately 1 and approximately 2 bar, then the pressure loss in pilot burner operation drops to virtually uselessly low values. Conversely, an acceptable pressure loss for pilot burner operation dictates a pressure loss in diffusion burner operation having an impracticable magnitude. If a tie line to a hybrid burner is to be used for both large and small throughputs of fluid, then its throttle action should be variable, and specifically should be slight for a high throughput and great for a small throughput.

It is accordingly an object of the invention to provide a fitting for connecting at least one hybrid burner to apparatus for supplying a fluid fuel, which overcomes the hereinafore-mentioned disadvantages of the heretofore-known devices of this general type and which enables stable, interruption-free operation of the hybrid burner, or of a plurality of hybrid burners, in a particularly wide working range. It should be possible to operate the main burner with support by a pilot light supplied by the auxiliary burner and to operate the auxiliary burner alone in either diffusion or premixing operation, depending on its structure.

With the foregoing and other objects in view there is provided, in accordance with the invention, in a burner and supply apparatus assembly including at least one hybrid burner having a main burner operable with premixing combustion and an auxiliary burner operable alone and operable to furnish a pilot light for the main burner, a main supply apparatus, and an auxiliary supply apparatus, a fitting for connecting the at least one hybrid burner to the main supply apparatus and the auxiliary supply apparatus, comprising a change-over or change element, a main feed line for communicating between the change-over element and the main supply apparatus, an auxiliary feed line for communicating between the change-over element and the auxiliary supply apparatus, a main tie line for communicating between the change-over element and the main burner, an auxiliary tie line for communicating between the change-over element and the auxiliary burner, the change-over element being operable in at least one first and at least one second switching state, in the at least one first switching state the main feed line communicating with the main tie line and the auxiliary feed line communicating with the auxiliary tie line, and in the at least one second switching state the main feed line communicating with the auxiliary tie line and the auxiliary feed line being blocked; and a switchable throttle element being connected in series with the auxiliary tie line for conducting a fuel flow, the throttle element being operable in the at least one first switching state with relatively slight throttling action and in the at least one second switching state with relatively great or high throttling action.

The fitting of the present invention has the following substantial advantages in comparison with the prior art:

The predominant portion of fuel for the hybrid burner is furnished by the main supply apparatus in every operating state. The auxiliary supply apparatus is used merely for supplying fuel to the auxiliary burner to make the "pilot light" for the main burner. The thermal output of the hybrid burner is thus generally effected by controlling the quantity of fuel furnished by the main supply apparatus. Control of the auxiliary supply apparatus is necessary only to the extent that the "pilot light" of the auxiliary burner needs to be adapted to the operating state of the main burner. Moreover, burdening the auxiliary supply apparatus with relatively high fuel throughputs for diffusion burner operation of the auxiliary burner when the main burner is not in operation, is dispensed with. Instead of two fuel supply apparatus with similar load capacities, only one main supply apparatus is necessary in combination with the fitting according to the invention, in order to furnish relatively large quantities of fuel, and only one auxiliary supply apparatus for supplying merely marginal quantities of fuel, possibly even with only a narrow control range. In order to provide for uniform fuel supply to a plurality of hybrid burners through a single fitting, the throttling actions of the tie lines leading to the hybrid burners and of all of the throttle restrictions communicating with these tie lines can be dimensioned for an acceptable pressure loss in any conceivable operating state.

In accordance with a further feature of the invention, the relatively great or high throttling action of the throttle element in the second switching state is approximately two times to approximately 10 times as high as the slight throttling action of the throttling element in the first switching state. In this way, given usual requirements in terms of performance, interruption-free operation of the auxiliary burner in every opening state can be assured.

In accordance with another feature of the invention, the change-over element can assume at least one third switching state, in which both the main feed line and the auxiliary feed line are blocked. This provides a particularly simple opportunity for switching off the hybrid burner, or the plurality of hybrid burners, and this option is independent of other possibly necessary control apparatus.

In accordance with a further feature of the invention, the throttle element includes a vessel that can be acted upon with fuel, the vessel having an inner wall surface including a first wall region having at least one first mouth for the auxiliary tie line and a second wall region having at least one second mouth for a transfer line communicating with the change-over element; a slide or matching element being in tight contact with and movable over the first wall region, manipulable from outside the vessel, and having at least one bore that is approximately perpendicular to the first wall region; the first wall region and the slide define two surfaces resting on one another and being displaceable relative to one another, one of the surfaces having a first larger opening and a second smaller opening and the other of the surfaces having a third opening with at least the diameter of the first opening; and the third opening can be made to coincide with the first opening for the first switching state and with the second opening for the second switching state. For instance, the first wall region may have a single opening, namely the mouth in the auxiliary tic line, and the slide may have two openings, both of which communicate with the transfer line discharging into the second wall region and can be made to coincide in alternation with the first mouth. The throttle element thus acts as a slide valve.

In accordance with an added feature of the invention, the first wall region of the vessel is constructed approximately prismatically and in preferably approximately cylindrically, and the slide is a hollow piston sealingly fitting into the first wall region and displaceable from outside the vessel. Such a vessel can be manufactured at a particularly advantageous cost and in particular offers the option of providing mouths for a plurality of auxiliary tie lines in the prismatic or cylindrical first wall region, for the simultaneous action of a plurality of hybrid burners. The second wall region of the vessel is advantageously defined by an end wall of the interior of the vessel, so that the flow of fuel from the transfer line into the interior of the vessel cannot be hindered by the hollow piston.

In accordance with an additional feature of the invention, the change-over element includes a vessel that can be acted upon with fuel, the vessel having an inner wall surface including a first end region having a first mouth for the main feed line and a second end region having a second mouth for the auxiliary feed line, and a prismatic and in particular cylindrical region having an axis and being disposed between the first end region and the second end region, disposed in this intermediate region are at least one third mouth for the main tie line and at least one fourth mouth for the auxiliary tie line, or a transfer line which communicates with the auxiliary tie line, also disposed in the vessel is a piston that is manipulable from outside and is displaceable along the axis over the prismatic region, the piston defining two chambers being sealed off from one another in the vessel, so that the first mouth is located in the first chamber and the second mouth is located in the second chamber, the piston having a slide extension protruding toward the first end region and being guidable sealingly over the prismatic region, and the slide extension having at least one first bore with which the third mouth can be made to coincide for the first switching state and with which the fourth mouth can be made to coincide for the second switching state. The change-over element also includes other components, in the form of typical manipulators for the piston, which need not be discussed herein.

The comments already made regarding the particular embodiment of the throttle element initially apply for the function of the change-over element as well. Beyond this, it is important for the first chamber formed in the interior of the vessel and defined by the piston, among other parts, to communicate with the main feed line, while the second chamber, which is separated from the first chamber by the piston, communicates with the auxiliary feed line. By moving the piston into the positions corresponding with the various switching states with external manipulators, connections are created between the first chamber or second chamber and the various tie lines, making the various mouths coincide with the various bores in the slide extension, or completely uncovering these mouths with the piston, so that they open directly into the first chamber or second chamber. As with the vessel already described for the change-over element, the vessel described for the throttle element is also especially suitable for the connection of tie lines to a plurality of hybrid burners.

In accordance with yet another feature of the invention, the slide extension of the piston is provided with a further or second bore having a diameter which is smaller than the diameter of the first bore, and which can be made to coincide with the third mouth that leads to the main tie line in the second switching state, in other words when the first bore is made to coincide with the fourth mouth leading to the auxiliary tie line. With a change-over element that is modified in this way, it is thus possible to supply a small quantity of fuel to the main burner, in order to start it up when only the auxiliary burner is in operation, in order to fill the main tie line in particular and possibly distributor apparatus in the main burner itself with fuel, even before the switchover to the first switching state and the start-up of the main burner. In this way, air, exhaust gases or fuel residues can be removed from the main burner and its feed lines, thus enabling interruption-free start-up.

In accordance with yet a further feature of the invention, the prismatic region of the vessel of the change-over element is constructed cylindrically, and the slide extension of the piston is constructed axially symmetrically with respect to the axis. The piston and the slide extension are thus constructed as substantially axially symmetrical hollow pistons.

In accordance with yet an added feature of the invention, the change-over element and the throttle element are combined into a single control element. In order to operate the fitting according to the invention, the change-over element and the throttle element should be moved regularly into first switching states and second switching states in synchronism. For this reason it is particularly advantageous to provide a single control element which combines the functions of the change-over element and the throttle element, instead of a change-over element and a separate throttle element. This considerably simplifies the fitting, because not only are otherwise-necessary transfer lines omitted but only a single adjuster is needed for manipulating the control element as well.

In accordance with yet an additional feature of the invention, the control element includes a vessel through which fuel can flow, the vessel having an inner wall surface including a first end region having a first mouth for the main feed line, a second end region having a second mouth for the auxiliary feed line, and a prismatic and in particular cylindrical region having an axis; at least one third mouth for the main tie line and at least one fourth mouth for the auxiliary tie line being disposed in the prismatic region, the third mouth being disposed between the first end region and the fourth mouth as seen in the direction of the axis; a piston being disposed in the vessel and being displaceable from outside over the prismatic region along the axis, the piston defining two chambers being sealed off from one another in the vessel, the first mouth being located in the first chamber and the second mouth being located in the second chamber; the piston having a slide extension being sealingly movable over the prismatic region, the slide extension having at least one first bore coinciding with the third mouth in the first switching state and with the fourth mouth in the second switching state; the third mouth being covered by the slide extension or by the piston in the second switching state; and the fourth mouth being closed by neither the piston nor the slide extension but instead being open into the second chamber in the first switching state.

The control element is thus constructed as a vessel with a prismatic, preferably cylindrical hollow chamber, in which a piston that is positionable by external adjusters, is movably disposed, so that first and second chambers that are sealed off from one another are created in the interior of the vessel, and the first chamber communicates with the main feed line while the second chamber communicates with the auxiliary feed line. Disposed on the piston is a slide extension that is sealingly guidable over the prismatic region of the inner wall surface of the vessel and has bores which connect the first chamber or the second chamber to the main tie line or the auxiliary tie line in accordance with the switching states. The possible blocking of mouths is effected in such a way that they are covered by the piston or the slide extension.

In accordance with again another feature of the invention, the prismatic region of the inner wall surface of the vessel is largely cylindrically constructed like the piston and its slide extension is axially symmetrical with respect to the axis of the vessel. As already explained for the change-over element and the throttle element, such a structure is particularly advantageous for the control element as well.

The presence of the first slide extension on the piston is necessary because the closure of the third mouth leading into the main tie line must be possible whenever the fitting is in the second switching state. This requires that the third mouth not be located on the far side of the end of the slide extension facing away from the piston in the first switching state. Instead, an opening in the slide extension that overlaps the third mouth in the first switching state is necessary.

In accordance with again a further feature of the invention, the piston has another slide extension in the second chamber being sealingly movable through the prismatic region and having at least one second bore formed therein coinciding with the fourth mouth in the first switching state.

The presence of a further or second slide extension which protrudes into the second chamber of the vessel and has a second bore which can be made to coincide with the fourth mouth for the first switching state, is not absolutely necessary for the function of the control element. However, a second slide extension having a second bore does make it possible in the first switching state to incorporate an additional throttle restriction, in the form of the aforementioned second bore, in the fuel path to the auxiliary burner for furnishing the pilot light. This is particularly advantageous whenever a single control element is to be used to supply a plurality of hybrid burners, in which case a distribution of the fuel to the tie lines leading to the burners takes place, as has already been described for the case with the throttle element and the change-over element.

In accordance with again an added feature of the invention, the piston and its slide extensions have axially symmetrical or cylindrical shapes. In this case as well, this is the most advantageous selection for the shape of the prismatic region.

In accordance with again an additional feature of the invention, the control element has a third bore provided in the first slide extension, which can be made to coincide with the third mouth, thus creating a communication with the main feed line in the second switching state, when the first bore communicates with the auxiliary feed line. As a result, filling of the main burner and of all of the corresponding feed lines with fuel becomes possible, for instance prior to ignition, thereby enabling interruption-free start-up of the main burner subsequent to operation of the auxiliary burner by itself.

A particular field to which the fitting of the invention is applicable is the supply of a plurality of hybrid burners, which are operable in parallel, with fuel from a single main supply apparatus and a single auxiliary supply apparatus.

Therefore, in accordance with still another feature of the invention, the auxiliary tie line of each hybrid burner has its own throttle element, yet all of the main tie lines and all of the auxiliary tie lines communicate with a single change-over element. The supply of fuel to the hybrid burners is thus effected through a single change-over element and as many throttle elements as there are hybrid burners.

In order to supply fuel to a plurality of hybrid burners that can be operated in parallel, in accordance with still a further feature of the invention, there is provided a single control element which combines the functions of a single change-over element associated with all of the hybrid burners and the functions of a plurality of throttle elements, with each hybrid burner having its own throttle element. Thus in order to control all of the hybrid burners, only a single main supply apparatus, a single auxiliary supply apparatus and a single control element, being switchable through suitable adjusters, are necessary. The result is a fitting that combines the maximum possible compactness with the greatest possible operational reliability, because it has the lowest possible number of actuators.

If the structure of a gas turbine system, for instance, requires the provision of a plurality of hybrid burners, then for the sake of uniformity and to simplify operation, it is desirable for all of the hybrid burners to be operated in parallel as much as possible. In order to achieve this optimally, it is recommended that the throttling actions of all of the tie lines serving the same purpose and the slight and great throttling actions of all of the throttle elements to be adapted to one another as closely as possible. Therefore, in accordance with still an added feature of the invention, all of the main tie lines have approximately the same throttling action; all of the auxiliary tie lines have approximately the same throttling action; all of the throttle elements have approximately the same slight throttling action; and all of the throttle elements have approximately the same great throttling action.

In accordance with still an additional feature of the invention, the fitting is used to operate the at least one hybrid burner.

In accordance with a concomitant feature of the invention, the fitting is used to construct a gas turbine system including the burner and supply apparatus assembly and the fitting.

The invention is not limited to disclosing a single fitting for operation of a single burner or a plurality of burners being operable in parallel. Further features are naturally included as well. For instance, a plurality of groups of hybrid burners may be provided, in which one group at a time is supplied through a fitting defined by the present invention. It is also possible for a hybrid burner or a plurality of hybrid burners intended for operation with various different fuels to be operated in alternation with two or more fuels through a plurality of fittings, and in particular two fittings, in accordance with the present invention.

Other features which are considered as characteristic for the invention are set forth in the appended claims.

Although the invention is illustrated and described herein as embodied in a fitting for joining at least one hybrid burner to apparatus for supplying a fluid fuel, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
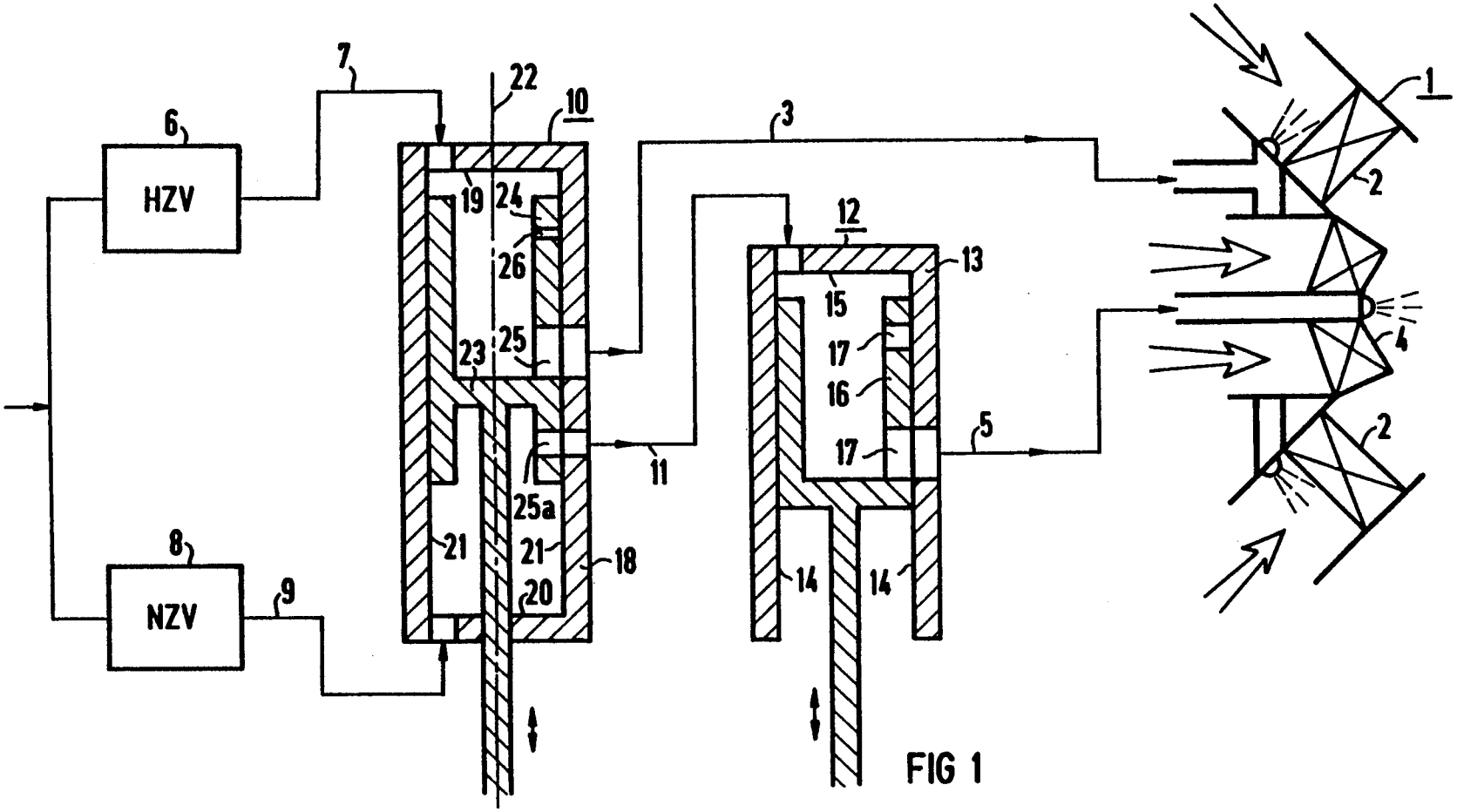
FIG. 1 is a partly fragmentary, diagrammatic, longitudinal-sectional view and partly block circuit diagram of a hybrid burner with apparatus for supplying fuel and with a fitting according to the invention.

Referring now to the figures of the drawing in detail and first, particularly, to FIG. 1 thereof, there is seen a hybrid burner 1 that communicates through a fitting according to the invention with a main supply apparatus 6 and an auxiliary supply apparatus 8, both of which are intended to supply a fluid fuel to the hybrid burner 1. The hybrid burner 1 has a main burner 2 in the form of a circular ring. A change-over or change element 10 communicates through a main feed line 7 with the main supply apparatus 6 and through an auxiliary feed line 9 with the auxiliary supply apparatus 8. The change-over element 10 also communicates with a main tie line 3 which leads to the main burner 2, and with a auxiliary tie line 5 which leads to an auxiliary burner 4. The auxiliary tie line 5 does not communicate directly with the change-over element 10. Instead, a transfer line 11 first leads from the change-over element 10 to the throttle element 12, from which the auxiliary tie line 5 then leads to the auxiliary burner 4. The change-over element 10 has various switching states, among which are a first switching state in which the main feed line 7 communicates with the main tie line 3 and the auxiliary feed line 9 communicates with the auxiliary tie line 5, and at least one second switching state in which the main tie line 7 communicates with the auxiliary tie line 5 and the auxiliary feed line 9 is blocked. In the first switching state, the main supply apparatus 6 thus communicates with the main burner 2 and the auxiliary supply apparatus 8 communicates with the auxiliary burner 4, and in the second switching state the main supply apparatus 6 communicates with the auxiliary burner 4 while the auxiliary supply apparatus 8 is disconnected from the hybrid burner 1.

The switchable throttle element 12 which is connected in series with the auxiliary tie line 5 and through which fuel can flow, likewise has a first switching state and a second switching state. The throttling action of the throttle element 12 for the fuel flow is slight in the first switching state and great or high in the second switching state, with the throttling actions preferably differing by a factor of from 2 to 10. The change-over element 10 and the throttle element 12 must each simultaneously assume the first or second switching state. If the change-over element 10 also has a third switching state, as will be described below, in which both the main supply apparatus 6 and the auxiliary supply apparatus 8 are disconnected from the hybrid burner 1, then naturally an optional third switching state of the throttle element 12 is unnecessary.

In the exemplary embodiment shown, the change-over element 10 has a substantially cylindrical vessel 18 that can be acted upon with fuel. An inner wall of the cylindrical vessel 18 has a first end region 19 with a first mouth for the main feed line 7, a second end region 20 with a second mouth for the auxiliary feed line 9, and a cylindrical region 21 having an axis 22 and being located between the first end region 19 and the second end region 20. A third mouth for the main tie line 3 and a fourth mouth for the transfer line 11 are provided in the cylindrical region 21. A piston 23 that is displaceable over the cylindrical region 21 along the axis 22, is also disposed in the vessel 18, forming two chambers that are sealed off from one another in the vessel 18. The first mouth is located in the first chamber and the second mouth is located in the second chamber. Disposed on the piston 23 is a slide extension 24 having at least one first bore 25 formed therein. The first bore 25 can be made to coincide with the third mouth for the first switching state and with the fourth mouth for the second switching state.

The slide extension 24 can advantageously be essentially rotationally symmetrically constructed with respect to the axis 22, like the cylindrical region 21. The slide extension 24 is provided with a second bore 26 which has a smaller diameter than the first bore 25, and which may overlap the third mouth in the second switching state, or in other words when the first bore 25 is made to coincide with the fourth mouth. In this way, when the auxiliary burner 4 is operated alone, it is possible to supply a small quantity of fuel to the main burner 2, in particular for filling the main tie line 3 in preparation for start-up of the main burner 2. In the first switching state, it must be assured that the fourth mouth is not covered by any possible extensions of the piston, so that there is a satisfactory communication between the second feed line 9 and the auxiliary tie line 5. Therefore, any extension of the piston 23 that may extend into the second region or chamber must be provided with a corresponding third bore **25*a***, which allows a flow into the fourth mouth in the first switching state.

The throttle element 12 has a vessel 13 that can be acted upon with fuel. The vessel 13 has an inner wall surface with a first wall region 14 having a first mouth for the auxiliary tie line 5 and a second wall region 15 having a second mouth for the transfer line 11. A slide 16 that is manipulable from outside the vessel 13 rests sealingly on the vessel. In the presently illustrated embodiment, the slide 16 is in the form of a hollow piston which is guidable over the first wall region 14 that is preferably cylindrical. However, the slide 16 may be any sort of an element that matches the vessel 13 so that they have surfaces resting on one another. The slide has two bores 17 of different sizes formed therein, both of which can be made to coincide with the first mouth in alternation. In the first switching state, the larger of the bores 17 is made to coincide with the first mouth. In the second switching state, the smaller of the bores 17 is made to coincide with the first mouth. The first wall region 14 of the vessel 13 is substantially cylindrical, and the second wall region 15 is approximately flat and perpendicular to the first wall region 14.

Figure 2:
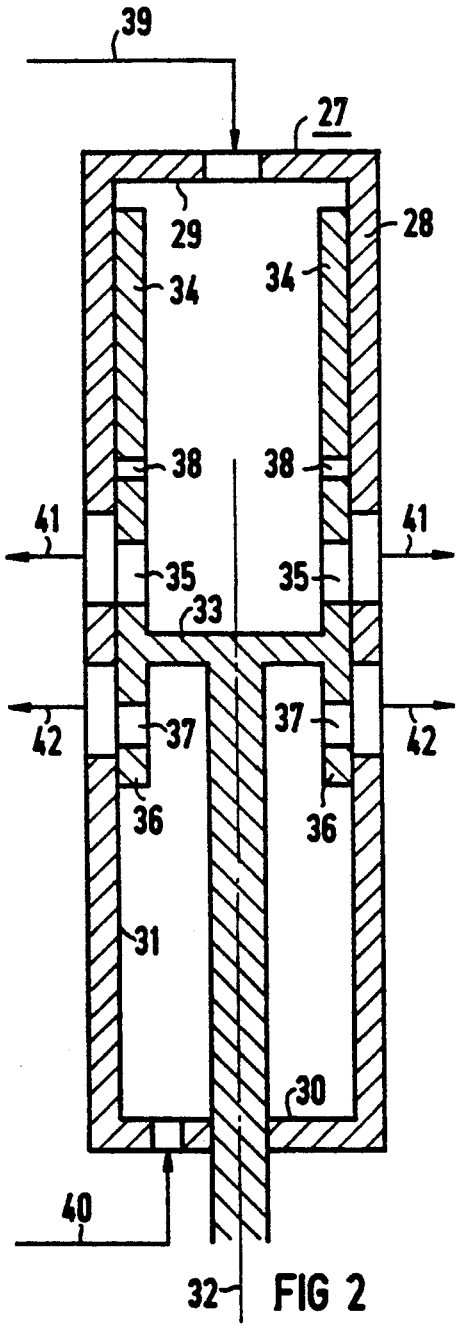
FIG. 2 is a fragmentary, longitudinal-sectional view of a version of a control elegant for the fitting according to the invention.

FIG. 2 shows a longitudinal section of a control element 27, which in itself combines the functions of the change-over element 10 and the throttle element 12 and is used in a particularly advantageous embodiment of the fitting of the present invention. The illustrated control element 27 also executes distributor functions, because it distributes the fuel flowing through a main feed line 39 and an auxiliary feed line 40 to a plurality, and specifically two, main tie lines 41 and auxiliary tie lines 42. An essential component of the control element 27 is a substantially straight, cylindrical vessel 28 having an axis 32 and an inner wall surface. The inner wall has a first end region 29 with a first mouth for the main feed line 39 and a second end region 30 with a second mouth for the auxiliary feed line 40, the first end region 29 and the second end region 30 both being disposed approximately perpendicular to the axis 32, and a prismatic and in particular cylindrical region 31 disposed between the end regions and parallel to the axis 32. The prismatic region has third mouths for the main tie lines 41 and fourth mouths for the auxiliary tie lines 42. As viewed along the axis 32, the third mouths are located between the first end region 29 and the fourth mouths. A piston 33, which is disposed in the vessel 28 and is displaceable over the prismatic region 31 along the axis 32, divides the interior of the vessel 28 into two chambers. A first chamber is defined by the first end region 29, and a second chamber is defined by the second end region 30. The piston 33 has a first slide extension 34 oriented toward the first end region 29 and a second slide extension 36 oriented toward the second end region 30. The first slide extension 34 is provided with first bores 35 and third bores 38. The second slide extension 36 has second bores 37 formed therein. In the first switching state which is shown in FIG. 2, the first bores 35 are made to coincide with the third mouths for the main tie lines 41, and the second bores 37 are made to coincide with the fourth mouths for the auxiliary tie lines 42. In this way, the main feed line 39 communicates with the main tie lines 41, and the auxiliary feed line 40 communicates with the auxiliary tie lines 42.

Figure 3:
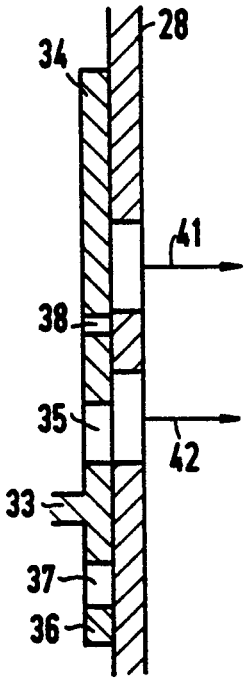
FIGS. 3 and 4 are fragmentary, longitudinal-sectional views of the control elements in various switching positions.

FIG. 3 is a fragmentary view of the vessel 28 shown in FIG. 2, in which the piston 33 has been moved to a position equivalent to the second switching state. The first bores 35 thus coincide with the fourth mouths, while the second bores 37 are blocked. Correspondingly, the auxiliary tie lines 42 communicate with the main feed line 39, and the auxiliary feed line 40 is blocked. The third bores 48 and the main tie lines 41 are also blocked.

Figure 4:
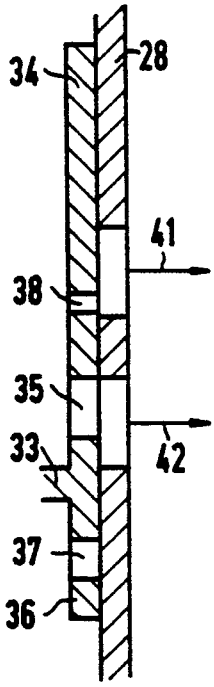
Figure 1:
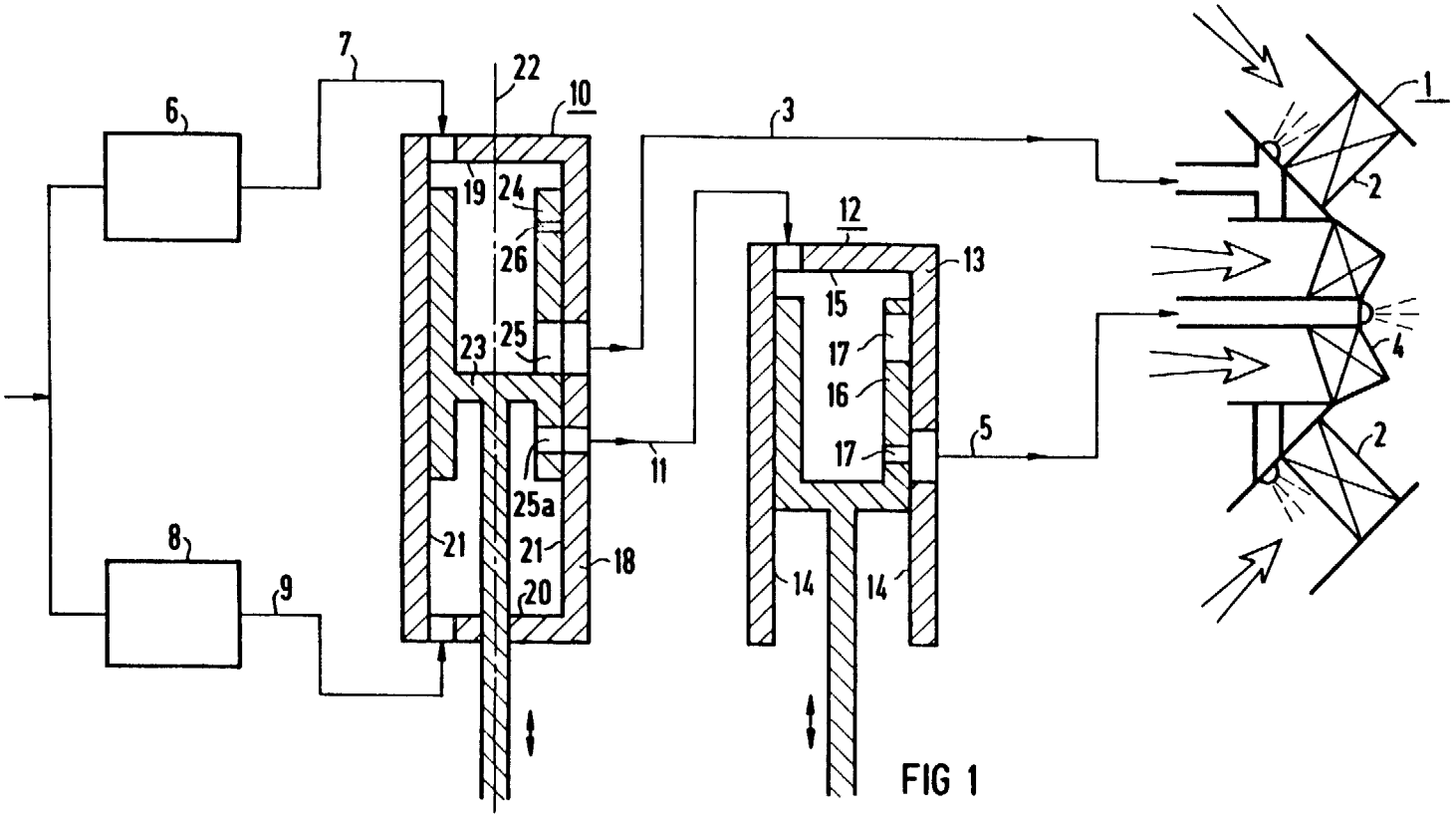

FIG. 4 is a further fragmentary view of the vessel 28, in which the piston 33 has been moved to a different position, corresponding to another second switching state. Once again the first bores 35 have been made to communicate with the fourth mouths. The third bores 38, which have small cross sections in comparison with the first bores 35 and the second bores 37, discharge into the third mouths. Thus the main tie lines 41 communicate with the main feed line 39, although the throttling action at the third bores 38 and associated with the respective main tie lines 41 is relatively great or high and they receive a small supply of fuel. In order to initiate operation of the main burners 2 shown in FIG. 1, this switching position can be used to fill the main tie lines 41 and optional further distributors in the hybrid burners 1 with fuel, and it can be used beforehand to blow out any gases present there. In this way, largely interruption-free start-up of heavy-duty operation of the hybrid burners 1 is possible.

The present invention pertains to a fitting for connecting at least one hybrid burner, including a main burner and an auxiliary burner, to a main supply apparatus and an auxiliary supply apparatus for supplying a fluid fuel. The fitting makes it possible to use a single main supply apparatus for high fuel throughput over a wide control range, along with an auxiliary supply apparatus for a comparably small fuel throughput in a narrow control range. Both operation of the auxiliary burner alone and operation of the main burner with support by a "pilot light" supplied by the auxiliary burner, are possible in a stable fashion over a wide control range.

What is claimed:

1. In a burner and supply apparatus assembly including:

at least one hybrid burner having a main burner operable with premixing combustion and an auxiliary burner operable to furnish a pilot light for the main burner, a main supply apparatus, and an auxiliary supply apparatus, a fitting for connecting the at least one hybrid burner to the main supply apparatus and the auxiliary supply apparatus, comprising:

a) a change-over element, a main feed line for communicating between said change-over element and the main supply apparatus, an auxiliary feed line for communicating between said change-over element and the auxiliary supply apparatus, a main tie line for communicating between said change-over element and the main burner, an auxiliary tie line for communicating between said change-over element and the auxiliary burner, said change-over element being operable in at least one first and at least one second switching state, in said at least one first switching state said main feed line communicating with said main tie line and said auxiliary feed line communicating with said auxiliary tie line, and in said at least one second switching state said main feed line communicating with said auxiliary tie line and said auxiliary feed line being blocked; and b) a switchable throttle element being connected in series with said auxiliary tie line for conducting a fuel flow, said throttle element being operable in said at least one first switching state with relatively slight throttling action and in said at least one second switching state with relatively great throttling action.

2. Fitting according to claim 1, wherein the relatively great throttling action is approximately between twice and ten times as great as the relatively slight throttling action of said throttle element.

3. Fitting according to claim 1, wherein said change-over element is operable in at least one third switching state in which said main feed line and said auxiliary feed line are blocked.

4. Fitting according to claim 1, including:

a) a transfer line for communicating between said change-over element and said throttle element, said throttle element having a vessel to be acted upon with fuel, said vessel having an inner wall surface including a first wall region having at least one first mouth formed therein for said auxiliary tie line and a second wall region having at least one second mouth formed therein for said transfer line;

b) a slide being in tight contact with said inner wall surface of said vessel and being manipulable from outside said vessel for moving said slide over said first wall region, said slide having a first relatively larger opening and a second relatively smaller opening formed therein approximately perpendicular to said first wall region, said first opening having a diameter being at most as large as the diameter of said first mouth; and c) said first mouth coinciding with said first opening in said first switching state and with said second opening in said second switching state by movement of said slide.

5. Fitting according to claim 4, wherein said first wall region of said inner wall surface of said vessel is approximately prismatic, and said slide is a hollow piston being fitted into said first wall region and displaceable from outside said vessel.

6. Fitting according to claim 5, wherein said approximately prismatic first wall region is approximately cylindrical.

7. Fitting according to claim 1, wherein:

a) said change-over element has a vessel to be acted upon with fuel, said vessel having an inner wall surface including a first end region having a first mouth formed therein for said main feed line, a second end region having a second mouth formed therein for said auxiliary feed line, and a prismatic region having an axis and being disposed between said first and second end regions;

b) said prismatic region having at least one third mouth formed therein for said main tie line and at least one fourth mouth formed therein for said auxiliary tie line;

c) a piston being disposed in said vessel and being manipulable from outside said vessel for displacing said piston over said prismatic region along the axis thereof, said piston defining first and second mutually sealed off chambers in said vessel, said first mouth being disposed at said first chamber and said second mouth being disposed at said second chamber;

d) said piston having a slide extension protruding toward said first end region and being sealingly guided over said prismatic region, said slide extension having at least one bore formed therein coinciding with said third mouth in said first switching state and coinciding with said fourth mouth in said second switching state by movement of said piston.

8. Fitting according to claim 7, wherein said prismatic region is cylindrical.

9. Fitting according to claim 7, including a transfer line for communicating between said at least one fourth mouth and said auxiliary tie line.

10. Fitting according to claim 7, wherein said at least one bore formed in said slide extension is at least one first bore, said slide extension has a second bore formed therein with a diameter being smaller than the diameter of said first bore, and said second bore coincides with said third mouth in said second switching state.

11. Fitting according to claim 8, wherein said slide extension is axially symmetrical with respect to the axis of said prismatic region.

12. Fitting according to claim 1, wherein said change-over element and said throttle element are combined into a single control element.

13. Fitting according to claim 12, wherein:

a) said single control element has a vessel through which fuel can flow, said vessel having an inner wall surface including a first end region having a first mouth formed therein for said main feed line, a second end region having a second mouth formed therein for said auxiliary feed line, and a prismatic region having an axis;

b) said prismatic region having at least one third mouth formed therein for said main tie line and at least one fourth mouth formed therein for said auxiliary tie line, said third mouth being disposed between said first end region and said fourth mouth, as seen along the axis of said prismatic region;

c) a piston being disposed in said vessel and being displaceable from outside said vessel over said prismatic region along the axis thereof, said piston defining first and second mutually sealed off chambers in said vessel, said first mouth being disposed at said first chamber and said second mouth being disposed at said second chamber;

d) said piston having a slide extension in said first chamber being sealingly movable over said prismatic region and having at least one bore formed therein coinciding with said third mouth in said first switching state and coinciding with said fourth mouth in said second switching state by movement of said piston;

e) said third mouth being covered by part of said piston in said second switching state; and f) said fourth mouth being uncovered by said piston and by said slide extension in said first switching state.

14. Fitting according to claim 13, wherein said prismatic region is cylindrical.

15. Fitting according to claim 13, wherein said part of said piston covering said third mouth in said second switching state is said slide extension.

16. Fitting according to claim 14, wherein said slide extension is axially symmetrical with respect to the axis of said prismatic region.

17. Fitting according to claim 13, wherein said at least one bore formed in said slide extension is at least one first bore, and said piston has another slide extension in said second chamber being sealingly movable through said prismatic region and having at least one second bore formed therein coinciding with said fourth mouth in said first switching state.

18. Fitting according to claim 17, wherein said prismatic region is cylindrical, and said other slide extension is axially symmetrical with respect to the axis of said prismatic region.

19. Fitting according to claim 13, wherein said slide extension has another bore formed between said first bore and said first mouth, and said other bore coincides with said third mouth in said second switching state.

20. Fitting according to claim 1, wherein the at least one hybrid burner is a plurality of hybrid burners to be supplied with a fluid fuel and operated in parallel, and including:

a) at least one other throttle element, at least one other main tie line, and at least one other auxiliary tie line;

b) each of said main tie lines communicating between said change-over element and a respective one of the hybrid burners, and each of said auxiliary tie lines communicating between a respective one of said throttle elements and a respective one of the hybrid burners.

21. Fitting according to claim 1, wherein the at least one hybrid burner is a plurality of hybrid burners to be supplied with a fluid fuel and operated in parallel, and including:

a) at least one other throttle element, at least one other main tie line, and at least one other auxiliary tie line;

b) said change-over element and all of said throttle elements being combined into a single control element;

c) each of said main tie lines communicating between said single control element and a respective one of the hybrid burners, and each of said auxiliary tie lines communicating between said single control element and a respective one of the hybrid burners.

22. Fitting according to claim 20, wherein:

a) all of said main tie lines have approximately the same throttling action;

b) all of said auxiliary tie lines have approximately the same throttling action;

c) all of said throttle elements have approximately the same slight throttling action; and d) all of said throttle elements have approximately the same great throttling action.

23. Fitting according to claim 21, wherein:

a) all of said main tie lines have approximately the same throttling action;

b) all of said auxiliary tie lines have approximately the same throttling action;

c) all of said throttle elements have approximately the same slight throttling action; and d) all of said throttle elements have approximately the same great throttling action.

24. Fitting for connecting at least one hybrid burner to a main supply apparatus and an auxiliary supply apparatus, comprising:

a) a change-over element, a main feed line for communicating between said change-over element and the main supply apparatus, an auxiliary feed line for communicating between said change-over element and the auxiliary supply apparatus, a main tie line for communicating between said change-over element and the hybrid burner, an auxiliary tie line for communicating between said change-over element and the hybrid burner, said change-over element having means for connecting said main feed line with said main tie line and said auxiliary feed line with said auxiliary tie line in at least one first switching state, and means for connecting said main feed line with said auxiliary tie line while blocking said auxiliary feed line in at least one second switching state; and b) a switchable throttle element for conducting a fuel flow in series with said auxiliary tie line, said throttle element having means for throttling relatively slightly in said first switching state and relatively greatly in said second switching state.

25. Fitting for connecting at least one hybrid burner to a main supply apparatus and an auxiliary supply apparatus, comprising a control element, a main feed line for communicating between said control element and the main supply apparatus, an auxiliary feed line for communicating between said control element and the auxiliary supply apparatus, a main tie line for communicating between said control element and the hybrid burner, an auxiliary tie line for communicating between said control element and the hybrid burner, said control element having:

a) means for connecting said main feed line with said main tie line and said auxiliary feed line with said auxiliary tie line in at least one first switching state, and means for connecting said main feed line with said auxiliary tie line while blocking said auxiliary feed line in at least one second switching state; and b) means for producing a throttling action associated with said auxiliary tie line, said throttling action producing means throttling relatively slightly in said first switching state and relatively greatly in said second switching state state.

26. In a gas turbine system including a burner and supply apparatus assembly having:

at least one hybrid burner having a main burner operable with premixing combustion and an auxiliary burner operable to furnish a pilot light for the main burner, a main supply apparatus, and an auxiliary supply apparatus, a fitting for connecting the at least one hybrid burner to the main supply apparatus and the auxiliary supply apparatus, comprising:

a) a change-over element, a main feed line for communicating between said change-over element and the main supply apparatus, an auxiliary feed line for communicating between said change-over element and the auxiliary supply apparatus, a main tie line for communicating between said change-over element and the main burner, an auxiliary tie line for communicating between said change-over element and the auxiliary burner, said change-over element being operable in at least one first and at least one second switching state, in said at least one first switching state said main feed line communicating with said main tie line and said auxiliary feed line communicating with said auxiliary tie line, and in said at least one second switching state said main feed line communicating with said auxiliary tie line and said auxiliary feed line being blocked; and b) a switchable throttle element being connected in series with said auxiliary tie line for conducting a fuel flow, said throttle element being operable in said at least one first switching state with relatively slight throttling action and in said at least one second switching state with relatively great throttling action.

27. Fitting according to claim 1, including:

a) a transfer line for communicating between said change-over element and said throttle element, said throttle element having a vessel to be acted upon with fuel, said vessel having a first wall region;

b) a matching element having a second wall region being in tight contact with said first wall region; and c) said first and second wall regions defining two surfaces resting on one another and being manipulable from outside said vessel for displacement relative to one another, one of said surfaces having a first opening with a relatively larger diameter and a second opening with a relatively smaller diameter formed therein approximately perpendicular to said one surface, the other of said surfaces having a third opening formed therein communicating with said auxiliary tie line and having a diameter being at least as large as the diameter of said first opening, and the other of said surfaces having a fourth opening formed therein communicating with said transfer line;

d) said third opening coinciding with said first opening in said first switching state and with said second opening in said second switching state.

* * * * *

UNITED STATES PATENT AND TRADEMARK OFFICE

CERTIFICATE OF CORRECTION

PATENT NO. : 5,066,221

DATED : November 19, 1991

INVENTOR(S) : BERNARD BECKER

It is certified that error appears in the above—identified patent and that said Letters Patent is hereby corrected as shown below:

In the title page, item (57), the ABSTRACT,
line 24, change "slight" to -- great --;
line 26, change "great" to -- slight --;
Column 3, line 5, change "slight" to -- great or high --;
line 6, change "great or high" to -- slight --;
line 67, change "larger" to -- smaller --;
line 68, change "smaller" to -- larger --;
Column 4, line 2, change "first" to -- second --;
Column 8, line 67, change "slight" to -- great or high --;
line 68, change "great or high" to -- slight --;
Column 9, line 66, change "larger" to -- smaller --;
line 68, change "smaller" to -- larger --;
Column 11, line 51, change "slight" to -- great --;
line 52, change "great" to -- slight --;
Column 12, line 7, change "larger" to -- smaller";
change "smaller" to -- larger --;
line 9, change "first" to -- second --;
Column 14, line 58, change "slightly" to -- greatly --;
line 59, change "greatly" to -- slightly --;
Column 15, line 11, change "slightly" to -- greatly --;
line 12, change "greatly" to -- slightly --;
Column 16, line 8, change "slight" to -- great --;
line 9, change "great" to -- slight --;
line 23, change "larger" to -- smaller --;
line 24, change "smaller" to -- greater --; and
line 29, change "first" to -- second --.

UNITED STATES PATENT AND TRADEMARK OFFICE

CERTIFICATE OF CORRECTION

PATENT NO. : 5,066,221

DATED : November 19, 1991

INVENTOR(S) : BERNARD BECKER

It is certified that error appears in the above-identified patent and that said Letters Patent is hereby corrected as shown below:

The title page should be deleted and substitute therefore the attached title page.

In the Drawing, Replace Fig. 1 with the new attached Fig. 1.

Signed and Sealed this

Tenth Day of August, 1993

*Attest:*

Michael K. Kirk

MICHAEL K. KIRK

*Attesting Officer*

*Acting Commissioner of Patents and Trademarks*

United States Patent [19]

Becker

[11] Patent Number: 5,066,221

[45] Date of Patent: Nov. 19, 1991

[54] FITTING FOR JOINING AT LEAST ONE HYBRID BURNER TO APPARATUS FOR SUPPLYING A FLUID FUEL

[75] Inventor: Bernard Becker, Mülheim an der Ruhr, Fed. Rep. of Germany

[73] Assignee: Siemens Aktiengesellschaft, Munich, Fed. Rep. of Germany

[21] Appl. No.: 639,600

[22] Filed: Jan. 9, 1991

[30] Foreign Application Priority Data

Jan. 9, 1990 [DE] Fed. Rep. of Germany ..... 4000446

[51] Int. Cl.[5] ..... F23Q 9/08

[52] U.S. Cl. ..... 431/280; 60/748; 137/625.18

[58] Field of Search ..... 431/280, 281; 60/747, 60/748; 137/625.18

[56] References Cited

U.S. PATENT DOCUMENTS

| | | | |
|---|---|---|---|
| 2,335,085 | 11/1943 | Roberts | 431/280 |
| 3,176,753 | 4/1965 | Townsend | 431/280 |
| 4,589,260 | 5/1986 | Krockow . | |
| 4,701,124 | 10/1987 | Maghon et al. . | |

FOREIGN PATENT DOCUMENTS

| | | |
|---|---|---|
| 0276696 | 8/1988 | European Pat. Off. . |
| 3606625 | 9/1986 | Fed. Rep. of Germany |

*Primary Examiner*—Carroll B. Dority

*Attorney, Agent, or Firm*—Herbert L. Lerner; Laurence A. Greenberg

[57] ABSTRACT

A hybrid burner has a main burner operable with premixing combustion and an auxiliary burner operable with premixing and/or diffusion combustion alone or operable to furnish a pilot light for the main burner. A fitting connects at least one hybrid burner to a main supply apparatus and an auxiliary supply apparatus. The fitting includes a change-over element. A main feed line communicates between the change-over element and the main supply apparatus, an auxiliary feed line communicates between the change-over element and the auxiliary supply apparatus, a main tie line communicates between the change-over element and the main burner and an auxiliary tie line communicates between the change-over element and the auxiliary burner. The change-over element is operable in at least one first and at least one second switching state. In the first switching state the main feed line communicates with the main tie line and the auxiliary feed line communicates with the auxiliary tie line. In the second switching state the main feed line communicates with the auxiliary tie line and the auxiliary feed line is blocked. A switchable throttle element is connected in series with the auxiliary tie line for conducting a fuel flow. The throttle element is operable in the first switching state with relatively slight throttling action and in the second switching state with relatively great throttling action.

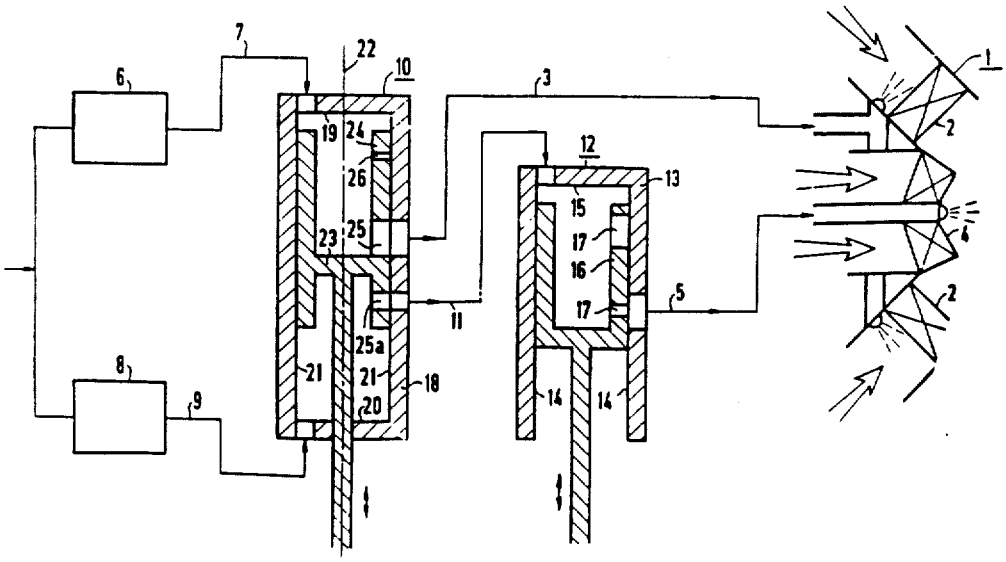

27 Claims, 2 Drawing Sheets